US010937606B2

(12) United States Patent
Betsuda et al.

(10) Patent No.: US 10,937,606 B2
(45) Date of Patent: Mar. 2, 2021

(54) PUSH-BUTTON SWITCH HAVING SOUND FUNCTION

(71) Applicant: NKK SWITCHES CO., LTD., Kawasaki (JP)

(72) Inventors: Nobuhiko Betsuda, Kawasaki (JP); Masahiro Aoyama, Kawasaki (JP); Yotaro Okano, Kawasaki (JP)

(73) Assignee: NKK SWITCHES CO., LTD., Kawasaki (JP)

( * ) Notice: Subject to any disclaimer, the term of this patent is extended or adjusted under 35 U.S.C. 154(b) by 0 days.

(21) Appl. No.: 17/043,314

(22) PCT Filed: Mar. 28, 2019

(86) PCT No.: PCT/JP2019/013795
§ 371 (c)(1),
(2) Date: Sep. 29, 2020

(87) PCT Pub. No.: WO2019/189663
PCT Pub. Date: Oct. 3, 2019

(65) Prior Publication Data

US 2021/0020390 A1 Jan. 21, 2021

(30) Foreign Application Priority Data

Mar. 29, 2018 (JP) ..... JP2018-066147

(51) Int. Cl.
*H01H 13/85* (2006.01)
*H01H 13/10* (2006.01)
(Continued)

(52) U.S. Cl.
CPC ..... *H01H 13/10* (2013.01); *H01H 13/20* (2013.01); *H01H 13/52* (2013.01); *H01H 13/85* (2013.01); *H01H 2215/03* (2013.01)

(58) Field of Classification Search
CPC .... H01H 13/85; H01H 2215/03; H01H 13/52; H01H 13/10; H01H 13/705;
(Continued)

(56) References Cited

U.S. PATENT DOCUMENTS

2017/0221653 A1* 8/2017 Liao ..... H01H 13/023
2018/0006648 A1* 1/2018 Liu ..... H03K 17/9622
(Continued)

FOREIGN PATENT DOCUMENTS

JP 2006049178 2/2006
JP 4384778 B2 12/2009
WO 2017028702 A1 2/2017

OTHER PUBLICATIONS

International Search Report for International Application No. PCT/JP2019/013795; dated May 28, 2019.

*Primary Examiner* — Ahmed M Saeed
(74) *Attorney, Agent, or Firm* — Cantor Colburn LLP

(57) ABSTRACT

A push-button switch has a sound function and a button accepts a pushing operation. A second plunger slides in coordination with the pushing operation on the button. A torsion coil spring stores or releases elastic energy together with sliding of the second plunger. A sounder unit slides using elastic energy released by the torsion coil spring at the same time as the torsion coil spring elastically deforms, and the sounder unit generates a hitting sound by impacting a hitting piece. A movable contact piece has a movable-side contact Pm and is capable of moving due to being pushed by the sliding sounder unit. A fixed contact piece has a fixed side contact, the movable-side contact Pm being engaged with the fixed side contact at the same time or substantially at the same time as the sounder unit hits the hitting piece.

5 Claims, 14 Drawing Sheets

(51) Int. Cl.
*H01H 13/52* (2006.01)
*H01H 13/20* (2006.01)

(58) Field of Classification Search
CPC .... H01H 2215/00; H01H 13/12; H01H 13/28; H01H 13/48; H01H 13/56; H01H 13/20; H01H 13/36; H01H 13/365; H01H 13/14; H01H 3/125; H01H 13/7065; H01H 2221/044; H01H 2221/036
See application file for complete search history.

(56) References Cited

U.S. PATENT DOCUMENTS

| | | | | |
|---|---|---|---|---|
| 2018/0074587 | A1* | 3/2018 | Liu | H01H 13/85 |
| 2018/0166231 | A1 | 6/2018 | Wu | |
| 2019/0172661 | A1* | 6/2019 | Hsieh | H01H 3/12 |
| 2019/0393004 | A1* | 12/2019 | Wang | H01H 13/705 |

* cited by examiner

PUSH-BUTTON SWITCH HAVING SOUND FUNCTION

CROSS REFERENCE TO RELATED APPLICATIONS

This is the U.S. national stage of application No. PCT/JP2019/013795, filed on Mar. 28, 2019. Priority under 35 U.S.C. § 119(a) and 35 U.S.C. § 365(b) is claimed from Japanese Application No. 2018-066147, filed Mar. 29, 2018, the disclosure of which is also incorporated herein by reference.

TECHNICAL FIELD

The present invention relates to a sound-function-equipped push-button switch.

BACKGROUND ART

There is a push-button switch (see Patent Document 1) having a sound function that notifies an operator, who has performed the pushing operation of the push-button switch, of acceptance of the pushing operation by a so-called click feeling or so-called click sound.

Patent Document 1: Japanese Patent No. 4384778

DISCLOSURE OF THE INVENTION

Problems to be Solved by the Invention

It is required for the push-button switch (hereinafter referred to as a "sound-function-equipped push-button switch") having the sound function that the timing (hereinafter referred to as "operation sound generation timing") of generating the sound in the pushing operation and the timing (hereinafter referred to as "contact opening/closing timing") of opening/closing a contact between a movable contact piece and a fixed contact piece are made at the same time or substantially at the same time. Since the operation sound generation timing and the contact opening/closing timing are made at the same time or substantially at the same time, a person having performed the pushing operation can reliably recognize that the pushing operation has been accepted. On this point, a typical sound-function-equipped push-button switch including the push-button switch described in Patent Document 1 is configured such that a sounder that generates the sound in the pushing operation and the contact pieces that open/close the contact are separately arranged and operation of the sounder and the operation of the contact pieces are separately performed through a plunger. Thus, to make the operation sound generation timing and the contact opening/closing timing at the same time or substantially at the same time, it is necessary to improve accuracy of the parts and accuracy of the assembly of each of the sounder and the contact pieces separately arranged. This increases the manufacturing cost.

The present invention has been made in view of such a situation, and an object of the present invention is to provide a sound-function-equipped push-button switch capable of easily making the click sound generation timing and the contact opening/closing timing at the same time or substantially at the same time without increasing manufacturing cost.

Means for Solving the Problems

For accomplishing the above-described object, the sound-function-equipped push-button switch according to the present invention includes a button that accepts the pushing operation, a plunger that slides in conjunction with the pushing operation of the button, a torsion coil spring that stores or releases elastic energy during sliding of the plunger, a sounder that slides using the elastic energy released at the same time as elastic deformation of the torsion coil spring and hits a hitting piece to generate a hitting sound, a movable contact piece that has a movable-side contact that is moved by being pushed by the sliding sounder, and a fixed contact piece that has a fixed side contact that locks the movable-side contact at the fixed side contact at the same time or substantially at the same time as hitting the sounder with the hitting piece.

According to this aspect of the invention, the sounder slides using the elastic energy of the torsion coil spring and hits the hitting piece to generate the hitting sound, and at the same time or substantially at the same time as hitting the sounder, the fixed side contact of the fixed contact piece locks the movable-side contact moved by sliding the sounder. Thus, operation sound generation timing and contact opening/closing timing can be easily made at the same time or substantially at the same time without increasing manufacturing cost. Note that "lock" in the present invention broadly means a state in which the moving movable-side contact contacts and is engaged with the fixed side contact, and is not limited to a state in which one contact is hooked on or engaged with the other contact.

The torsion coil spring preferably has a first shaft pivotally-supported on the plunger and a second shaft pivotally-supported on the sounder, and preferably stores elastic energy while bending such that the first shaft approaches the second shaft when the plunger slides downward in a state in which the second shaft is locked by the sounder, and when the plunger further slides in a state in which the first shaft is positioned closest to the second shaft, is preferably reversed to release the stored elastic energy while stretching such that the second shaft moves apart from the first shaft and preferably slides the sounder upward. According to this aspect of the invention, the sounder slides using the elastic energy of the torsion coil spring and hits the hitting piece to generate the hitting sound, and at the same time or substantially at the same time as hitting the sounder, the fixed side contact of the fixed contact piece locks the movable-side contact moved by sliding the sounder. Thus, the operation sound generation timing and the contact opening/closing timing can be easily made at the same time or substantially at the same time without increasing manufacturing cost.

The torsion coil spring preferably has two coils formed between the first shaft and the second shaft facing each other. According to this aspect of the invention, two coils are formed between the first shaft and the second shaft facing each other. Thus, while the first shaft pivotally-supported on part of the plunger and the second shaft pivotally-supported on part of the sounder are maintained in a parallel state, the second shaft can be stably moved up and down about the first shaft as the point of support. That is, while an outer wall surface of the plunger and the sounder are maintained in a parallel state, the sounder can be stably moved up and down. Further, durability for millions of pushing operations is required for the torsion coil spring, and for this reason, a more-expensive thicker material is generally used rather than a less-expensive thinner material. However, the torsion coil spring formed by two coils allows even the less-expensive thinner material to have durability for millions of pushing operations.

The torsion coil spring is preferably pivotally supported on the plunger to rotate about the first shaft when the plunger slides downward.

The movable contact piece and the fixed contact piece preferably form a contact unit. According to this aspect of the invention, the contact unit has a multiplicity of uses.

Effects of the Invention

According to this aspect of the invention, the movable-side contact is electrified by contacting the fixed side contact at the same time as generation of the hitting sound by the sounder. Thus, the operation sound generation timing and the contact opening/closing timing can be easily made at the same time or substantially at the same time without increasing manufacturing cost.

PREFERRED MODE FOR CARRYING OUT THE INVENTION

A sound-function-equipped push-button switch 1 according to one embodiment of the present invention will be described with reference to the drawings. Note that the present invention is not limited to the embodiment described below.

First Embodiment

[Basic Configuration]

Figure 1:
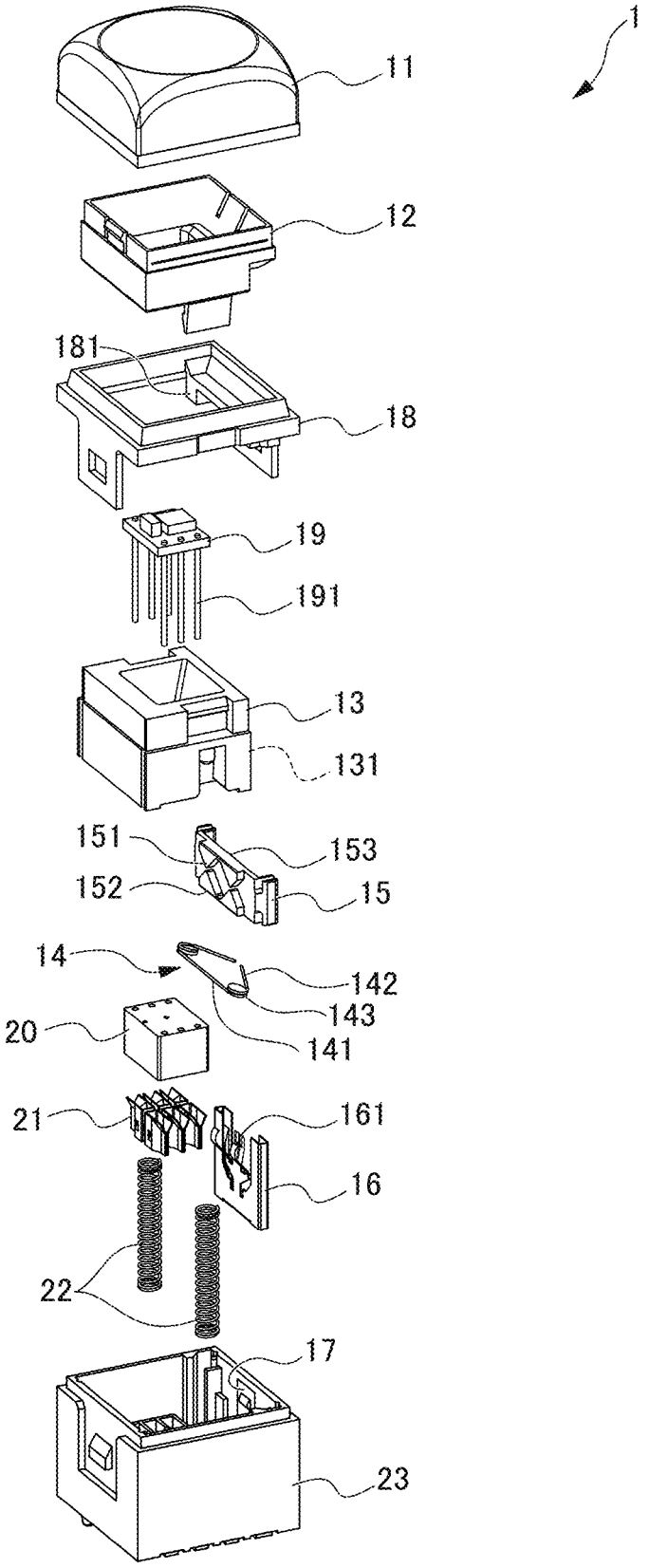
FIG. 1 is a perspective view of a sound-function-equipped push-button switch according to a first embodiment of the present invention.

A sound-function-equipped push-button switch 1 according to a first embodiment is a push-button switch having the function of making operation sound generation timing and contact opening/closing timing at the same time or substantially at the same time. The sound-function-equipped push-button switch 1 includes, as shown in FIG. 1, a button 11, a first plunger 12, a second plunger 13, a torsion coil spring 14, a sounder 15, a movable contact piece 16, a fixed contact piece 17, a cover 18, a light emission member 19, a spacer 20, a connector 21, a coil spring 22, and a housing 23.

Hereinafter, each component of the sound-function-equipped push-button switch 1 according to the first embodiment will be described in detail.

(Button)

The button 11 is a button that accepts the pushing operation for the sound-function-equipped push-button switch 1, and as shown in FIG. 1 to FIG. 3C, is arranged at an uppermost portion of the sound-function-equipped push-button switch 1. Although described in detail later, when the pushing operation is performed of the button 11, the first plunger 12, the second plunger 13, the torsion coil spring 14, the sounder 15, and the movable contact piece 16 operate in conjunction with each other, and the movable contact piece 16 and the fixed contact piece 17 contact each other and are brought into an electrified state. When the movable contact piece 16 and the fixed contact piece 17 are separated from each other from a contact state, a disconnected state is established. That is, the above-described "contact opening/closing timing" indicates the timing at which the movable contact piece 16 and the fixed contact piece 17 contact each other and are brought into the electrified state and the timing at which the movable contact piece 16 and the fixed contact piece 17 are separated from each other and are brought into the disconnected state. When the movable contact piece 16 and the fixed contact piece 17 contact each other, an upper end portion 153 of the sounder 15 hits a hitting piece 181 of the cover 18 to generate a hitting sound. When the movable contact piece 16 and the fixed contact piece 17 are separated from each other, a lower end portion 152 of the sounder 15 hits a corner portion 231 of an inner wall of the housing 23 to generate the hitting sound. That is, the above-described "operation sound generation timing" indicates the timing at which the upper end portion 153 of the sounder 15 hits the hitting piece 181 of the cover 18 and the timing at which the lower end portion 152 of the sounder 15 hits the corner portion 231 of the inner wall of the housing 23. Note that the shape of the button 11 is not particularly limited, but in the present embodiment, is a cylindrical shape rounded as shown in FIG. 1 to FIG. 3C.

(First Plunger)

The first plunger 12 is arranged so as to be coupled to a lower portion of the button 11. When the pushing operation is performed of the button 11, the first plunger 12 slides downward together with the later-described second plunger 13. Note that the shape of the first plunger 12 is not particularly limited, but in the present embodiment, is a quadrangular prism shape having a hollow at a center portion as shown in FIG. 1 to FIG. 3C.

(Second Plunger)

The second plunger 13 is arranged so as to be coupled to a lower portion of the first plunger 12. The second plunger 13 is a plunger that slides up and down together with the above-described first plunger 12, and has a surface facing parallel with or substantially parallel with the sounder 15, the movable contact piece 16, and the fixed contact piece 17 described later. The second plunger 13 has, on part of this surface, a first shaft support portion 131 that pivotally supports a first shaft 141 of the torsion coil spring 14 described later. Note that the shape of the second plunger 13 is not particularly limited, and in the present embodiment, is a quadrangular prism shape having a hollow at a center portion as shown in FIG. 1 to FIG. 3C.

(Torsion Coil Spring)

Figure 2A:
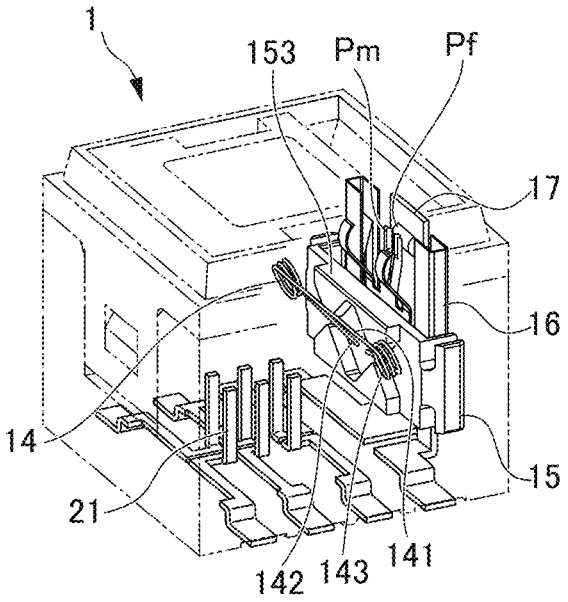
FIG. 2A is a perspective view (a transparent view) showing a state when the pushing operation is performed for the sound-function-equipped push-button switch of FIG. 1 in a disconnected state, FIG. 2A showing a state before the pushing operation is performed.
Figure 3A:
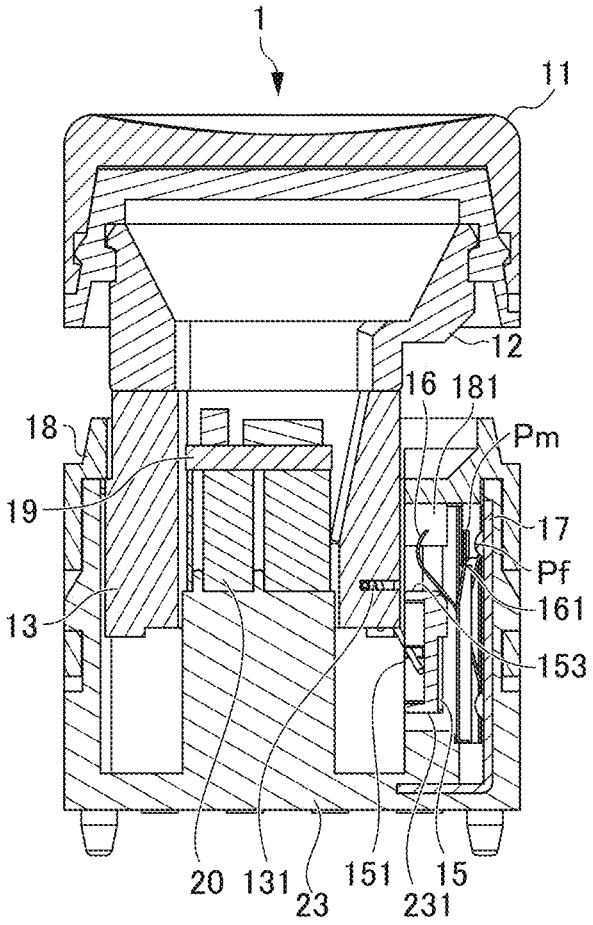
FIG. 3A is a sectional view showing the state when the pushing operation is performed for the sound-function-equipped push-button switch of FIG. 1 in the disconnected state, FIG. 3A showing the state before the pushing operation is performed.
Figure 3B:
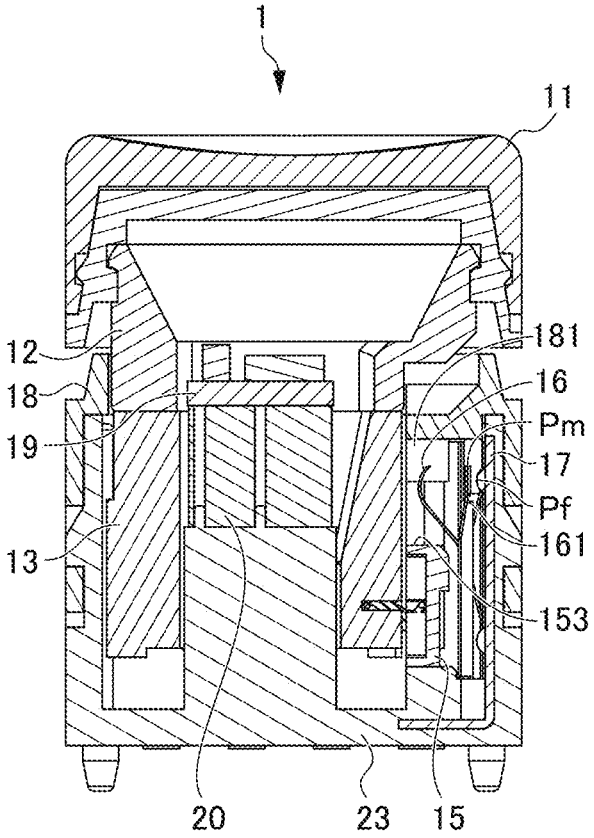
FIG. 3B is a sectional view showing the state when the pushing operation is performed for the sound-function-equipped push-button switch of FIG. 1 in the disconnected state, FIG. 3B showing the state in the middle of the pushing operation.
Figure 3C:
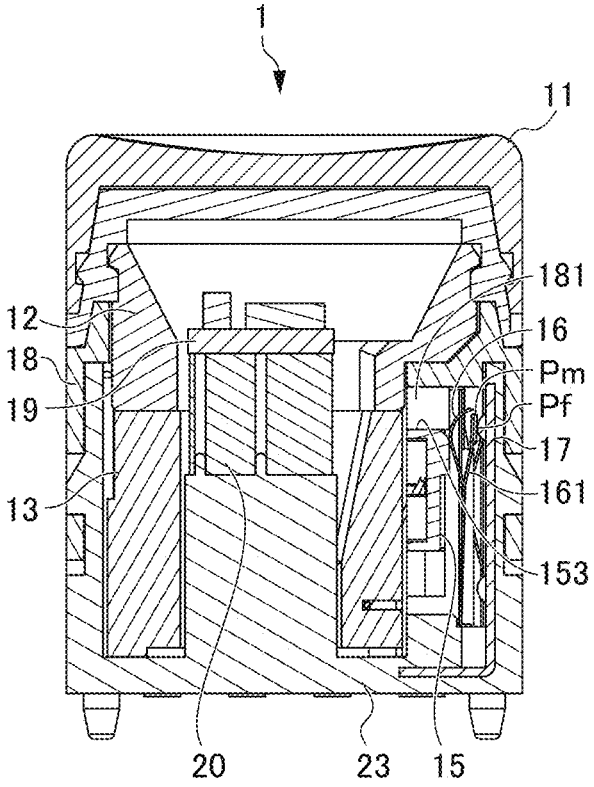
FIG. 3C is a sectional view showing the state when the pushing operation is performed for the sound-function-equipped push-button switch of FIG. 1 in the disconnected state, FIG. 3C showing the state upon electrification by the pushing operation.

The torsion coil spring 14 is pivotally supported on the second plunger 13 to rotate about the first shaft 141 when the second plunger 13 slides downward. Specifically, the torsion coil spring 14 includes two coils 143 formed between the first shaft 141 and a second shaft 142 arranged facing each other. The first shaft 141 is pivotally supported by the first shaft support portion 131 of the second plunger 13, and the second shaft 142 is pivotally supported by a second shaft support portion 151 provided at part of the later-described sounder 15. When the sound-function-equipped push-button switch 1 is in the disconnected state, a position relationship between the first shaft support portion 131 and the second shaft support portion 151 is that the first shaft support portion 131 is positioned above the second shaft support portion 151, and the lower end portion 152 of the sounder 15 is positioned at the corner portion 231 of the inner wall of the housing 23, as shown in FIG. 2A and FIG. 3A. In this state, when the pushing operation of the button 11 starts, the second plunger 13 starts sliding downward in conjunction with the pushing operation. Accordingly, the torsion coil spring 14 stores elastic energy while bending such that the first shaft 141 approaches the second shaft 142. When the second plunger 13 further slides downward in a state in which the torsion coil spring 14 bends such that the first shaft 141 and the second shaft 142 are positioned closest to each other, the torsion coil spring 14 is reversed to release the stored elastic energy while stretching such that the second shaft 142 moves apart from the first shaft 141. The released elastic energy is transmitted to the sounder 15 through the second shaft support portion 151. Thus, the sounder 15 slides upward to flip up. Accordingly, the upper end portion 153 of the upward-slid sounder 15 hits the hitting piece 181 of the cover 18 to generate the hitting sound.

When the operation (hereinafter referred to as "return operation") of returning the button 11 in the state of pushing operation upward by the torsion coil spring 14 starts, the second plunger 13 starts sliding upward in conjunction with the return operation. Accordingly, the torsion coil spring 14 stores elastic energy while bending such that the first shaft 141 approaches the second shaft 142 again. When the second plunger 13 further slides upward in a state in which the torsion coil spring 14 bends such that the first shaft 141 is positioned closest to the second shaft 142 again, the torsion coil spring 14 is reversed to release the stored elastic energy while stretching such that the second shaft 142 moves apart from the first shaft 141. The released elastic energy is transmitted to the sounder 15 through the second shaft support portion 151. Thus, the sounder 15 slides downward. Accordingly, the lower end portion 152 of the downward-slid sounder 15 hits the corner portion 231 of the inner wall of the housing 23 to generate the hitting sound.

(Sounder)

The sounder 15 is a member for generating sound when the pushing operation of the button 11 is performed, and slides using the elastic energy released at the same time as elastic deformation of the torsion coil spring 14 and hits the hitting piece 181 to generate the hitting sound. Specifically, the sounder 15 has the second shaft support portion 151 that pivotally supports the second shaft 142 of the torsion coil spring 14. As described above, the lower end portion 152 of the sounder 15 is arranged at the corner portion 231 of the inner wall of the housing 23 when the sound-function-equipped push-button switch 1 is in the disconnected state. When the pushing operation of the button 11 starts and the plunger slides downward in a state in which the second shaft 142 is locked by the sounder 15, the torsion coil spring 14 stores elastic energy while bending such that the first shaft 141 approaches the second shaft 142. When the plunger further slides in a state in which the first shaft 141 is positioned closest to the second shaft 142, the torsion coil spring 14 is reversed to release the stored elastic energy while stretching such that the second shaft 142 moves apart from the first shaft 141, and slides the sounder 15 upward. When the torsion coil spring 14 is reversed, an operator recognizes the reversal of the torsion coil spring 14 as a so-called click feeling with the fingertip. Then, the upper end portion 153 of the upward-slid sounder 15 hits the hitting piece 181 of the cover 18 to generate the hitting sound.

(Movable Contact Piece)

The movable contact piece 16 is a conductor that is moved by being pushed by the sounder 15, and at an end portion, has a movable portion 161 as a movable-side contact Pm. When the movable-side contact Pm and a fixed side contact Pf in a separated state contact each other, these contacts are electrified. When the movable-side contact Pm and the fixed side contact Pf in the contact state are separated from each other, these contacts are disconnected from each other. Specifically, the movable portion 161 of the movable contact piece 16 is, as shown in FIG. 1 to FIG. 3C, configured movably by being pushed by the sounder 15. When the sounder 15 is flipped up by the force of the torsion coil spring 14, the upper end portion 153 of the sounder 15 pushes the movable portion 161 of the movable contact piece 16. At the same time as generation of the hitting sound by hitting of the upper end portion 153 with the hitting piece 181 of the cover 18, the movable-side contact Pm and the fixed side contact Pf in the separated state contact each other and are brought into the electrified state.

When the return operation is performed of the button 11 in a pushed state, the first plunger 12 and the second plunger 13 slide in conjunction with the return operation, and the torsion coil spring 14 is reversed again. Accordingly, the sounder 15 slides downward. Thus, the movable portion 161 of the movable contact piece 16 in a state in which the movable portion 161 is pushed by the sounder 15 is released from the sounder 15. Accordingly, the movable-side contact Pm and the fixed side contact Pf in the contact state are separated from each other and are brought into the disconnected state. At this point, the sounder 15 slides downward to hit the corner portion 231 of the inner wall of the housing 23, thereby generating the hitting sound.

(Fixed Contact Piece)

The fixed contact piece 17 is a conductor arranged on part of the inner wall of the housing 23. The fixed contact piece 17 is electrified in such a manner that the fixed side contact Pf of the fixed contact piece 17 and the movable-side contact Pm of the movable portion 161 of the movable contact piece 16 contact each other, and is disconnected in such a manner that the fixed side contact Pf of the fixed contact piece 17 and the movable-side contact Pm of the movable portion 161 of the movable contact piece 16 are separated from each other. That is, the sound-function-equipped push-button switch 1 is opened/closed by contact/separation of the fixed side contact Pf of the fixed contact piece 17 and the movable-side contact Pm of the movable portion 161 of the movable contact piece 16.

(Cover)

The cover 18 is a lid for covering an upper portion of the housing 23. At a center portion of the cover 18, a space (a hollow) for sliding the first plunger 12 and the second plunger 13 up and down is provided. Moreover, in a ceiling portion of the cover 18, the hitting piece 181 for generating the sound by hitting of the upper end portion 153 of the sounder 15 is provided. Note that the shape of the cover 18 is not particularly limited, but in the present embodiment, is a quadrangular shape having the hollow at the center portion as shown in FIG. 1 to FIG. 3C.

(Light Emission Member)

The light emission member 19 is a member that emits light to enhance visibility of the button 11, and emits light according to an opening/closing state of the sound-function-equipped push-button switch 1. Thus, the sound-function-equipped push-button switch 1 can cause the operator etc. to perceive opening/closing operation by the hitting sound of the sounder 15 via the sense of hearing and via the sense of vision by light emission from the light emission member 19. A specific configuration of the light emission member 19 is not particularly limited. For example, the light emission member 19 may be an organic EL or an LED. In the present embodiment, multiple light-emitting diodes are connected in parallel or in series, and an emission color is controlled according to the opening/closing state of the sound-function-equipped push-button switch 1. For example, green light may be emitted in a state in which the sound-function-equipped push-button switch 1 is ON, and red light may be emitted in a state in which the sound-function-equipped push-button switch 1 is OFF. The light emission member 19 emits light in response to the power supply from the connector 21 through conductive portions 191.

(Spacer)

The spacer 20 is arranged in the hollow provided at the center portion of the second plunger 13, and supports the light emission member 19. Specifically, multiple holes for penetration of the conductive portions 191 for supplying power to the light emission member 19 are provided at the spacer 20, and end portions of the conductive portions 191 having penetrated the spacer are connected to the connector 21 arranged at a lower portion of the spacer 20.

(Connector)

Figure 2B:
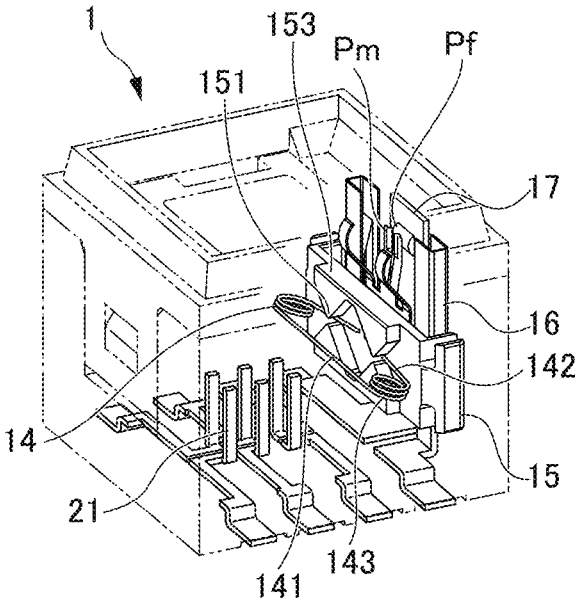
FIG. 2B is a perspective view (a transparent view) showing the state when the pushing operation is performed for the sound-function-equipped push-button switch of FIG. 1 in the disconnected state, FIG. 2B showing a state in the middle of the pushing operation.
Figure 2C:
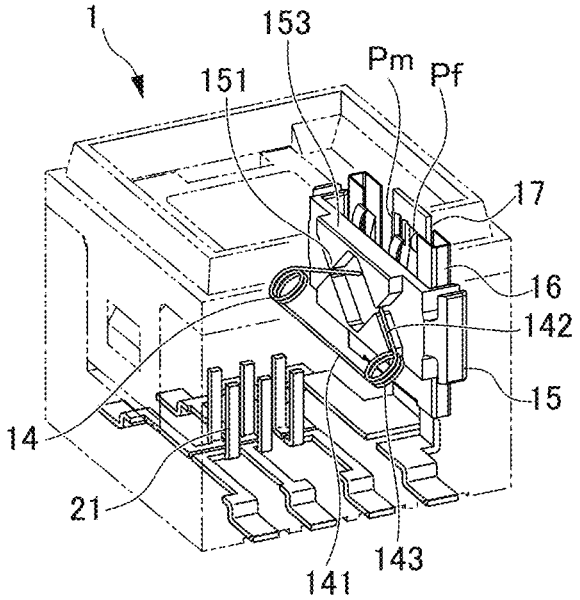
FIG. 2C is a perspective view (a transparent view) showing the state when the pushing operation is performed for the sound-function-equipped push-button switch of FIG. 1 in the disconnected state, FIG. 2C showing a state upon electrification by the pushing operation.

As shown in FIG. 2A to FIG. 2C, the connector 21 forms part of the fixed side conductor together with the fixed contact piece 17. As described above, the connector 21 supplies the power for light emission from the light emission member 19 through the conductive portions 191.

(Coil Spring)

By elastic deformation of the coil springs 22, the button 11, the first plunger 12, and the second plunger 13 slid downward by the pushing operation of the button 11 are returned to the state before the pushing operation is performed. When the button 11 returns, the second plunger slides upward in a state in which the upper end portion 153 of the sounder 15 is locked to the hitting piece 181 of the cover 18. Thus, right after the torsion coil spring 14 has bent such that the first shaft 141 and the second shaft 142 are positioned closest to each other again, the torsion coil spring 14 is elastically deformed to slide the sounder 15 downward. Then, the downward-slid sounder 15 hits the corner portion 231 of the inner wall of the housing 23 to generate the hitting sound. The torsion coil spring 14 may have a spiral portion between the first shaft 141 and the second shaft 142, and the number of windings of the spiral portion is not particularly limited. However, the number of winding is preferably three or more, and more preferably two.

(Housing)

The housing 23 is a box-shaped housing having a storage space for housing many sections of the sound-function-equipped push-button switch 1, and supports the fixed side conductor. When the pushing operation of the button 11 is not performed, the housing 23 stores the second plunger 13, the torsion coil spring 14, the sounder 15, the movable contact piece 16, the fixed contact piece 17, the spacer 20, the connector 21, and the coil spring 22. When the pushing operation of the button 11 is performed, part of a bottom portion of the first plunger 12 also enters the housing 23. Specifically, when the pushing operation of the button 11 is not performed, the sounder 15 is arranged at the corner portion 231 of the inner wall of the housing 23. Note that the shape of the housing 23 is not particularly limited, and in the present embodiment, is a quadrangular box shape as shown in FIG. 1 to FIG. 3C. With the above-described configuration of the sound-function-equipped push-button switch 1, the operation sound generation timing and the contact opening/closing timing can be easily made at the same time or substantially at the same time without increasing manufacturing cost. Note that in the present embodiment, the hitting piece 181 is provided at the cover 18, but is not particularly limited as long as the hitting piece 181 is provided at a location where the sounder 15 can hit the hitting piece 181. The hitting piece 181 may be provided at the first plunger 12, the fixed contact piece 17, or the housing 23.

Next, the flow of the pushing operation for the sound-function-equipped push-button switch 1 as shown in FIG. 2A to FIG. 2C and FIG. 3A to FIG. 3C will be described with reference to the flowchart of FIG. 4.

Figure 4:
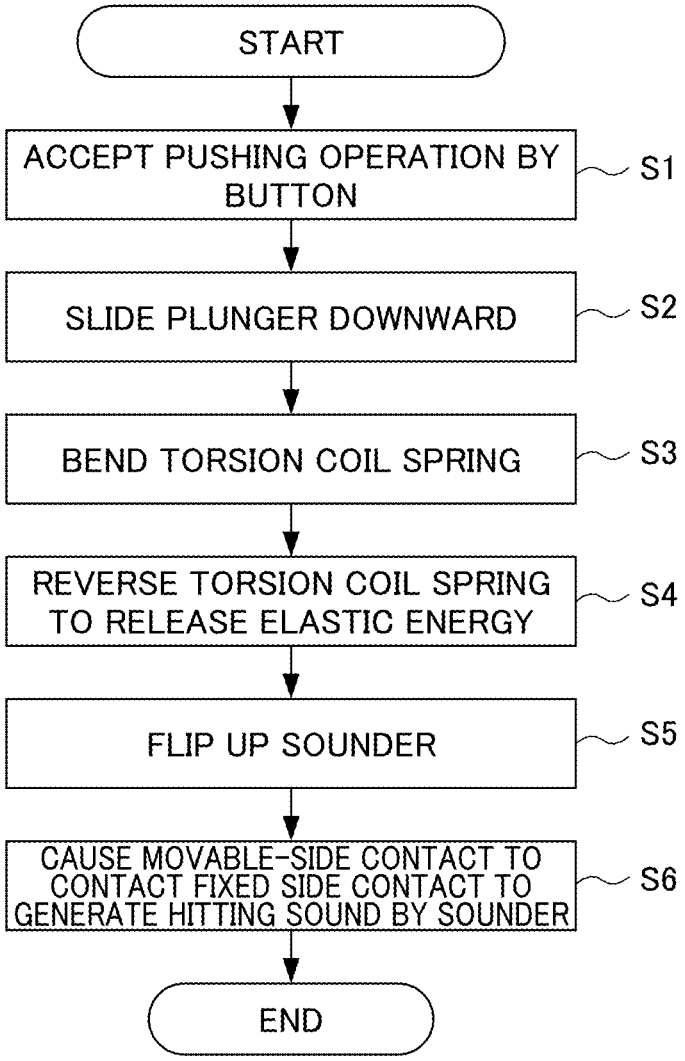
FIG. 4 is a flowchart showing a flow when the pushing operation is performed for the sound-function-equipped push-button switch of FIG. 1 in the disconnected state.

FIG. 4 is a flowchart for describing a series of events from the start of the pushing operation of the button 11 of the sound-function-equipped push-button switch 1 until the electrified state is made at the same time or substantially at the same time as sound production.

At Step S1, the button 11 starts sliding downward in response to the pushing operation. At Step S2, the first plunger 12 and the second plunger 13 starts sliding downward in conjunction with operation of the button 11. At Step S3, the torsion coil spring 14 stores elastic energy while bending such that the first shaft 141 and the second shaft 142 approach each other. At Step S4, when the second plunger 13 further slides downward in a state in which the first shaft 141 and the second shaft 142 are positioned closest to each other, the torsion coil spring 14 is reversed to release the stored elastic energy while stretching such that the second shaft 142 moves apart from the first shaft 141. The released elastic energy is transmitted to the sounder 15 through the second shaft support portion 151. At Step S5, the sounder 15 slides to flip up by means of the elastic energy transmitted through the second shaft support portion 151. At Step S6, the upward-slid sounder 15 hits the hitting piece 181 of the cover 18 to generate the hitting sound. Moreover, at the same time as generation of the hitting sound by hitting of the sounder 15 with the hitting piece 181 of the cover 18, the movable-side contact Pm and the fixed side contact Pf in the separated state contact each other and are brought into the electrified state.

Second Embodiment

[Basic Configuration]

Figure 5:
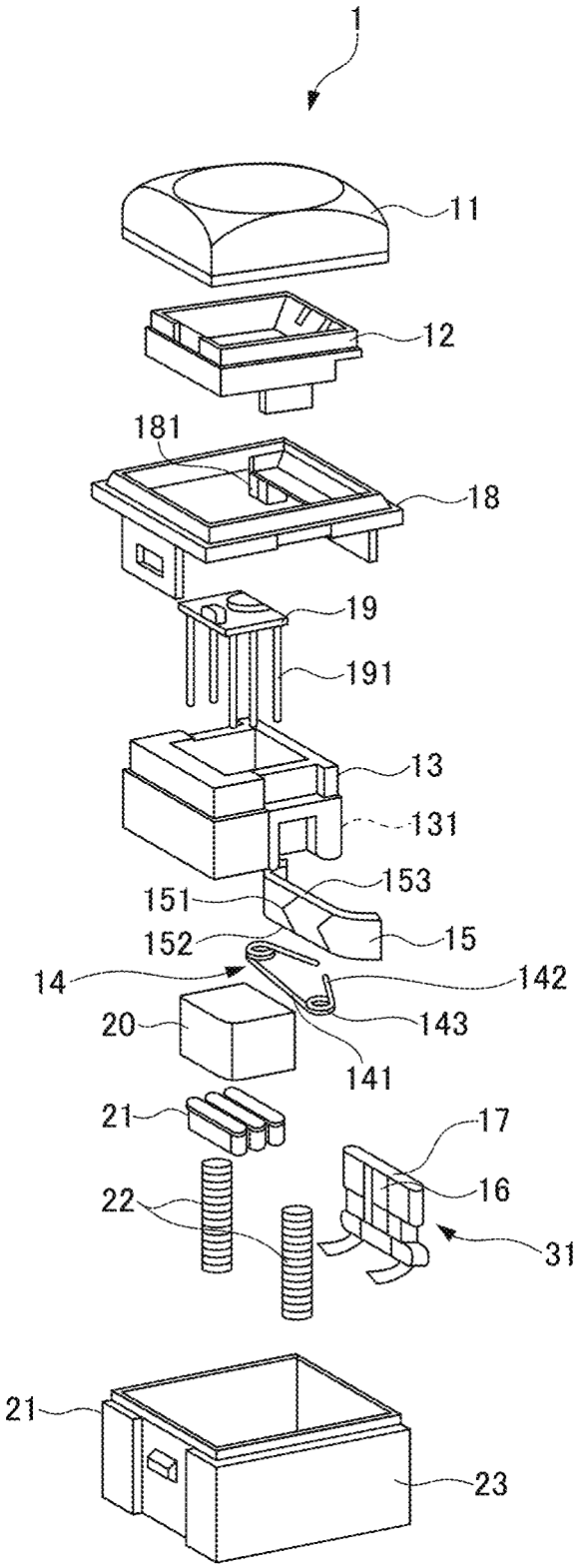
FIG. 5 is a perspective view of a sound-function-equipped push-button switch according to a second embodiment of the present invention.
Figure 6A:
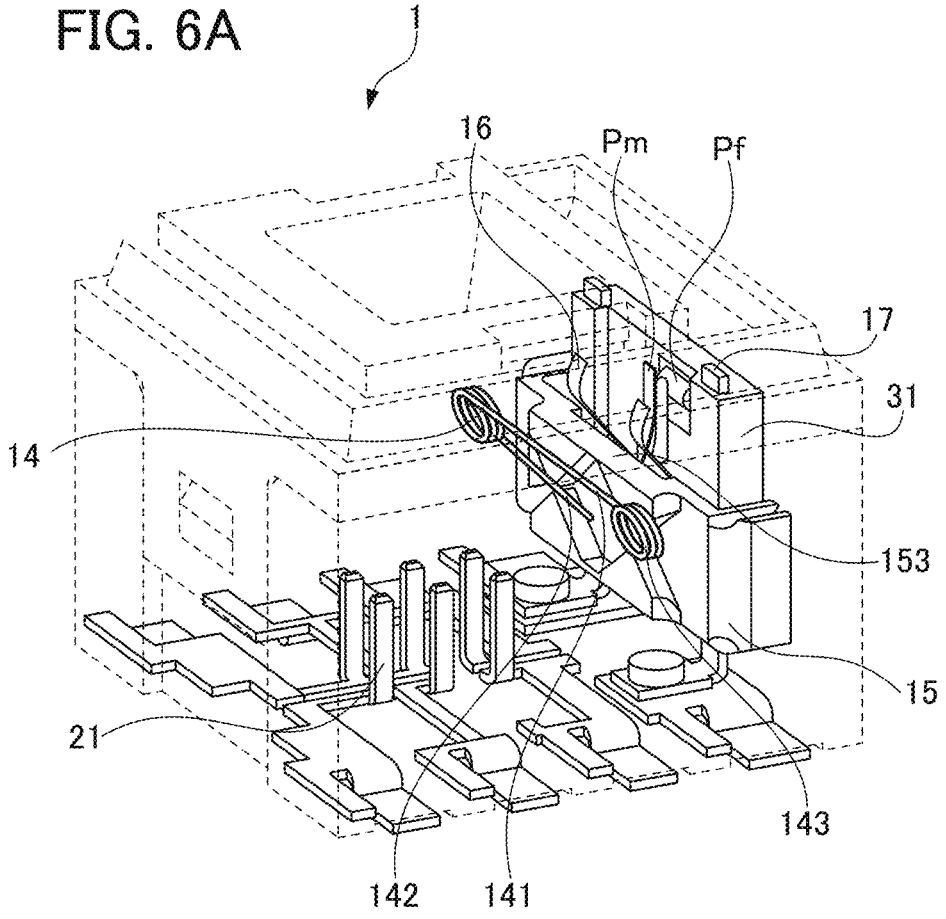
FIG. 6A is a perspective view (a transparent view) showing a state when the pushing operation is performed for the sound-function-equipped push-button switch of FIG. 5 in a disconnected state, FIG. 6A showing a state before the pushing operation is performed.
Figure 6B:
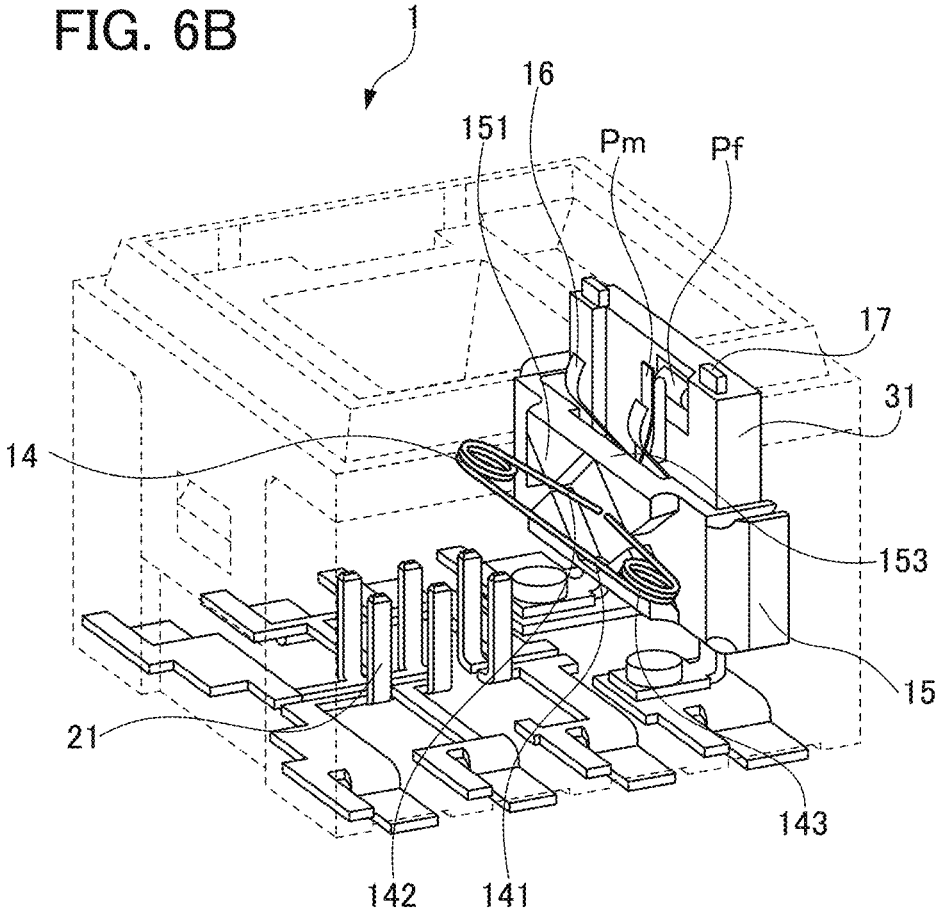
FIG. 6B is a perspective view (a transparent view) showing the state when the pushing operation is performed for the sound-function-equipped push-button switch of FIG. 5 in the disconnected state, FIG. 6B showing a state in the middle of the pushing operation.
Figure 6C:
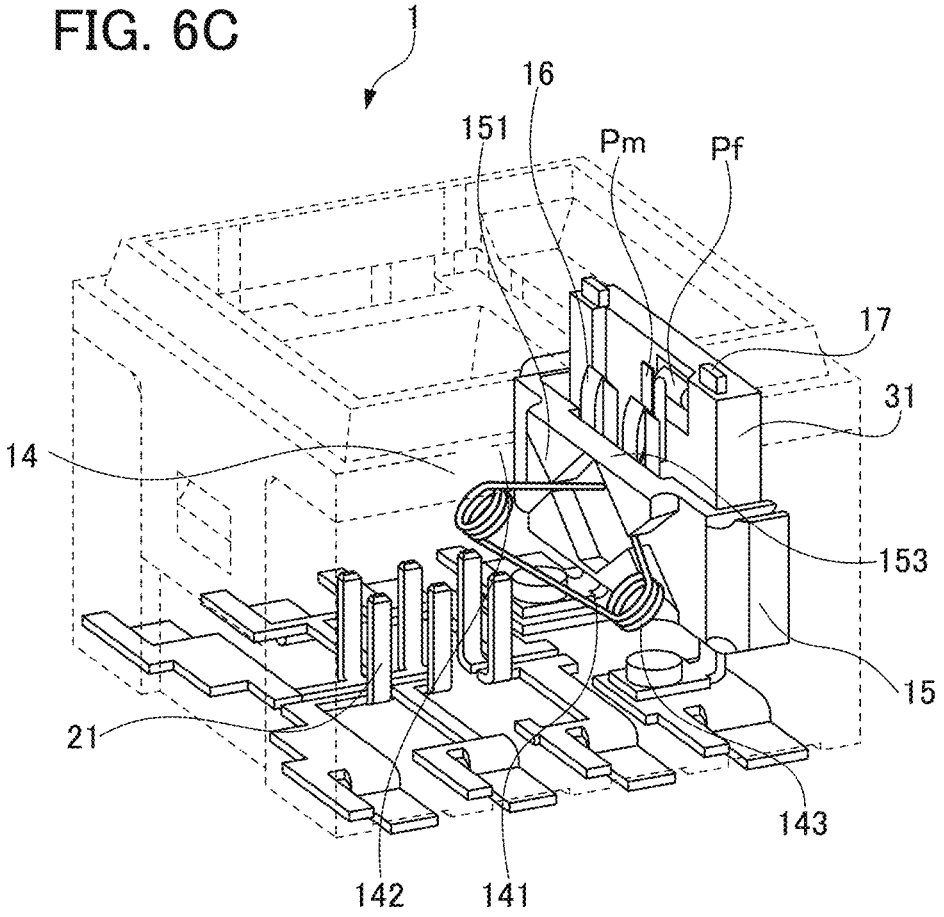
FIG. 6C is a perspective view (a transparent view) showing the state when the pushing operation is performed for the sound-function-equipped push-button switch of FIG. 5 in the disconnected state, FIG. 6C showing a state upon electrification by the pushing operation.
Figure 7A:
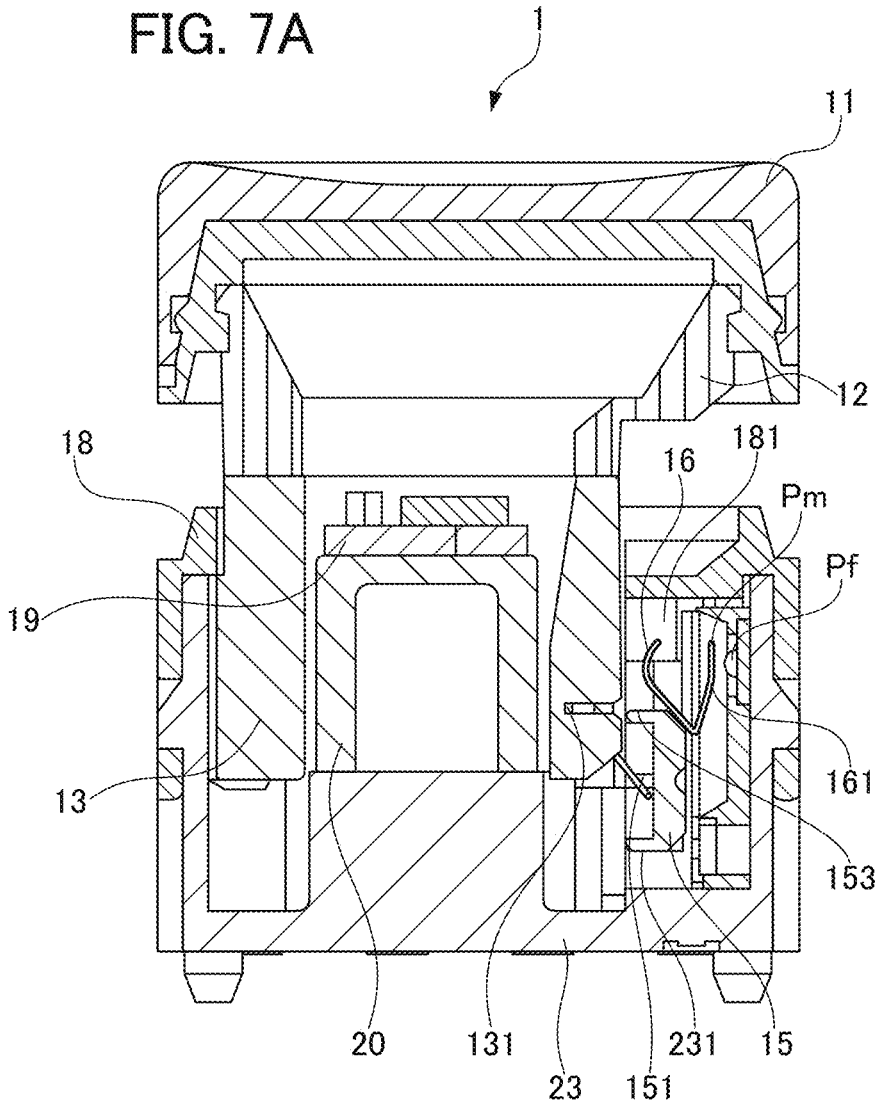
FIG. 7A is a sectional view showing the state when the pushing operation is performed for the sound-function-equipped push-button switch of FIG. 5 in the disconnected state, FIG. 7A showing the state before the pushing operation is performed.
Figure 7B:
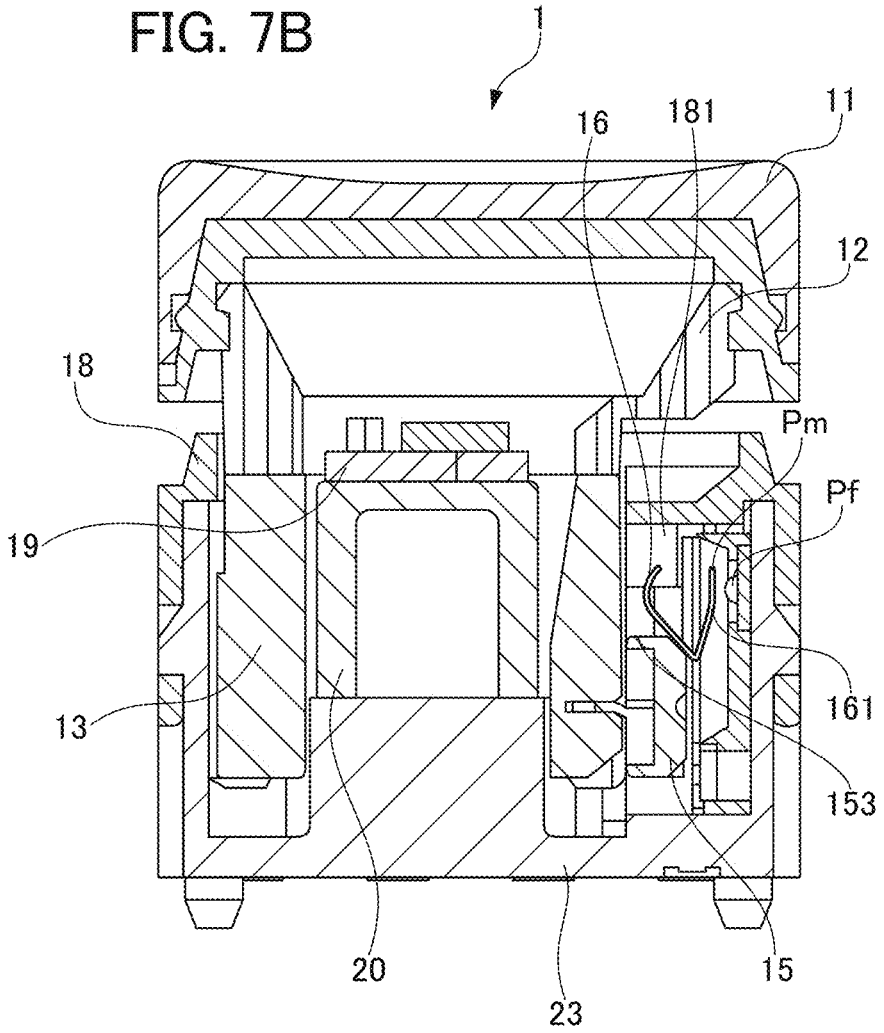
FIG. 7B is a sectional view showing the state when the pushing operation is performed for the sound-function-equipped push-button switch of FIG. 5 in the disconnected state, FIG. 7B showing the state in the middle of the pushing operation.
Figure 7C:
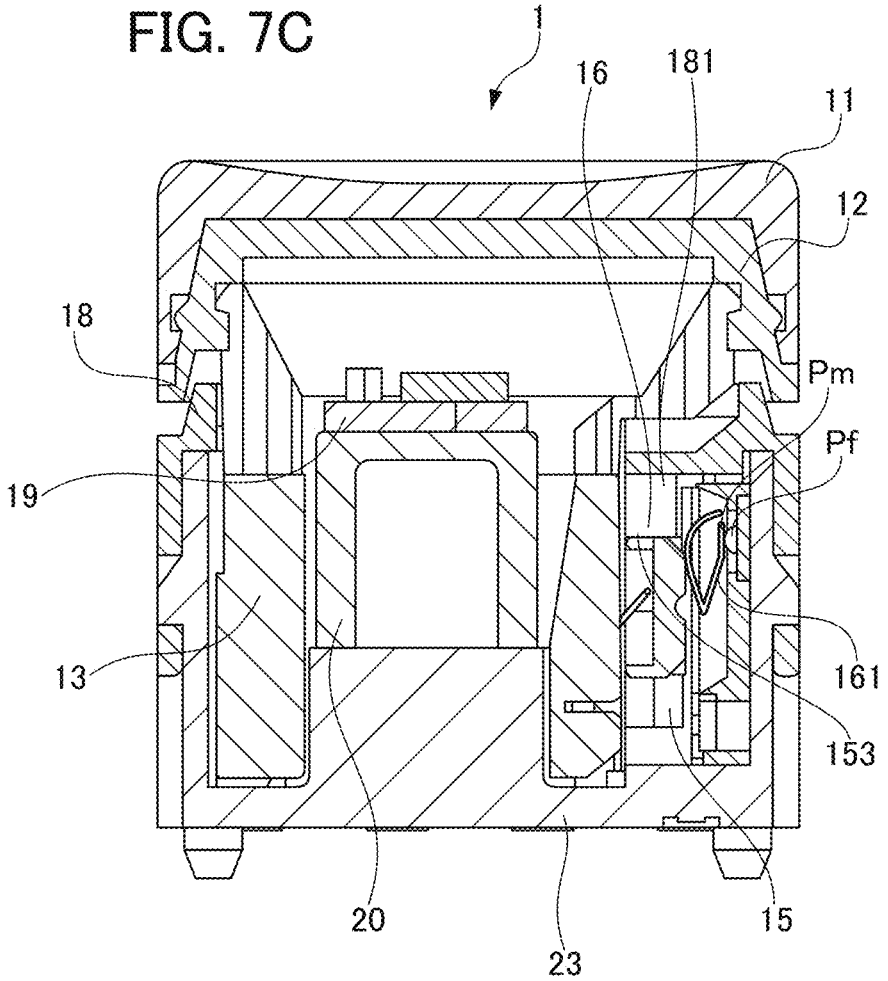
FIG. 7C is a sectional view showing the state when the pushing operation is performed for the sound-function-equipped push-button switch of FIG. 5 in the disconnected state, FIG. 7C showing the state upon electrification by the pushing operation.

As in the first embodiment, a sound-function-equipped push-button switch 1 according to a second embodiment is a push-button switch having the function of making operation sound generation timing and contact opening/closing timing at the same time or substantially at the same time. A basic configuration of the sound-function-equipped push-button switch 1 according to the second embodiment includes, as shown in FIG. 5, a button 11, a first plunger 12, a second plunger 13, a torsion coil spring 14, a sounder 15, a contact unit 31, a cover 18, a light emission member 19, a spacer 20, a connector 21, a coil spring 22, and a housing 23. Note that the sound-function-equipped push-button switch 1 according to the second embodiment is different from the sound-function-equipped push-button switch 1 according to the first embodiment in that the contact unit 31 having a movable contact piece 16 and a fixed contact piece 17 is provided as a component.

Hereinafter, each component of the sound-function-equipped push-button switch 1 according to the second embodiment will be described in detail. Note that configuration of the button 11, the first plunger 12, the second plunger 13, the torsion coil spring 14, the sounder 15, the cover 18, the light emission member 19, the spacer 20, the connector 21, the coil spring 22, and the housing 23 are similar to those of the first embodiment, and therefore, description thereof will be omitted.

The contact unit 31 is a mechanism including the movable contact piece 16 and the fixed contact piece 17.

The movable contact piece 16 of the contact unit 31 is a conductor that is moved by being pushed by the sounder 15, and at an end portion, has a movable portion 161 as a movable-side contact Pm. When the movable-side contact Pm and a fixed side contact Pf in a separated state contact each other, these contacts are electrified. When the movable-side contact Pm and the fixed side contact Pf in a contact state are separated from each other, these contacts are disconnected from each other. Specifically, as shown in FIG. 5 to FIG. 7C, the contact unit 31 is configured such that the movable portion 161 is moved by being pushed by the sounder 15. When the sounder 15 is flipped up by the force of the torsion coil spring 14, an upper end portion 153 of the sounder 15 pushes the movable portion 161. At the same time as generation of the hitting sound by hitting of the upper end portion 153 with a hitting piece 181 of the cover 18, the movable-side contact Pm and the fixed side contact Pf in the separated state contact each other and are brought into an electrified state.

When return operation of the button 11 in a pushed state is performed, the first plunger 12 and the second plunger 13 slide in conjunction with the return operation, and the torsion coil spring 14 is reversed again. Accordingly, the sounder 15 slides downward. Thus, the movable portion 161 pushed by the sounder 15 is released from the sounder 15. Accordingly, the movable-side contact Pm and the fixed side contact Pf in the contact state are separated from each other and are brought into a disconnected state. At this point, the sounder 15 slides downward to hit a corner portion 231 of an inner wall of the housing 23, thereby generating the hitting sound.

The fixed contact piece 17 of the contact unit 31 is a conductor having the fixed side contact Pf. The fixed contact piece 17 is electrified in such a manner that the fixed side contact Pf and the movable-side contact Pm contact each other, and is disconnected in such a manner that the fixed side contact Pf and the movable-side contact Pm are separated from each other. That is, the sound-function-equipped push-button switch 1 is opened/closed by contact/separation of the fixed side contact Pf and the movable-side contact Pm.

One embodiment of the present invention has been described above, but it should be noted that the present invention is not limited to the above-described embodiment. Modifications, improvements, etc. made within a scope in which the object of the present invention can be achieved are encompassed by the present invention. Further, various changes may be made without departing from the scope of the present invention.

In summary, it is enough that the sound-function-equipped push-button switch to which the present invention is applied has the following configuration, and various embodiments can be employed. That is, the sound-function-equipped push-button switch (e.g., the sound-function-equipped push-button switch 1 of FIG. 1 or FIG. 5) to which the present invention is applied includes a button (e.g., the button 11 of FIG. 1 or FIG. 5) that accepts the pushing operation, a plunger (e.g., the first plunger 12 and the second plunger 13 of FIG. 1 or FIG. 5) that slides in conjunction with the pushing operation of the button, a torsion coil spring (e.g., the torsion coil spring 14 of FIG. 1 or FIG. 5) that stores or releases elastic energy during sliding of the plunger, a sounder (e.g., the sounder 15 of FIG. 1 or FIG. 5) that slides using the elastic energy released at the same time as elastic deformation of the torsion coil spring and hits a hitting piece (e.g., the collision piece 181 of FIG. 3A to FIG. 3C or FIG. 7A to FIG. 7C) to generate a hitting sound, a movable contact piece (e.g., the movable contact piece 16 of FIG. 1 or FIG. 5) that has a movable-side contact (e.g., the movable-side contact Pm of FIG. 1 or FIG. 5) that is moved by being pushed by the sliding sounder, and a fixed contact piece (e.g., the fixed contact piece 17 of FIG. 1 or FIG. 5) that has a fixed side contact (e.g., the fixed side contact Pf of FIG. 1 or FIG. 5) that locks the movable-side contact at the fixed side contact at the same time or substantially at the same time as hitting of the sounder with the hitting piece. With this configuration, the sounder slides using the elastic energy of the torsion coil spring and hits the hitting piece to generate the hitting sound, and at the same time or substantially at the same time as hitting of the sounder, the fixed contact piece locks the movable-side contact at the fixed side contact. Thus, the operation sound generation timing and the contact opening/closing timing can be easily made at the same time or substantially at the same time without increasing manufacturing cost.

In the sound-function-equipped push-button switch according to the present invention, the torsion coil spring can have a first shaft (e.g., the first shaft 141 of FIG. 1 or FIG. 5) pivotally-supported on the plunger and a second shaft (e.g., the second shaft 142 of FIG. 1 or FIG. 5) pivotally-supported on the sounder, can store elastic energy while bending such that the first shaft approaches the second shaft when the plunger slides downward in a state in which the second shaft is locked by the sounder, and when the plunger further slides in a state in which the first shaft is positioned closest to the second shaft, can be reversed to release the stored elastic energy while stretching such that the second shaft moves apart from the first shaft and can slide the sounder upward. With this structure, the sounder slides using the elastic energy of the torsion coil spring and hits the hitting piece to generate the hitting sound, and at the same time or substantially at the same time as hitting of the sounder, the fixed contact piece locks the movable-side contact at the fixed side contact. Thus, the operation sound generation timing and the contact opening/closing timing can be easily made at the same time or substantially at the same time without increasing manufacturing cost.

In the sound-function-equipped push-button switch according to the present invention, the torsion coil spring can have two coils (e.g., the coils 143 of FIG. 1 or FIG. 5) formed between the first shaft and the second shaft facing each other. With this configuration, two coils are formed between the first shaft and the second shaft facing each other. Thus, while the first shaft pivotally-supported on part of the plunger and the second shaft pivotally-supported on part of the sounder are maintained in a parallel state, the second shaft can be stably moved up and down about the first shaft as the point of support. That is, while an outer wall surface of the plunger and the sounder are maintained in a parallel state, the sounder can be stably moved up and down. Further, durability for millions of pushing operations is required for the torsion coil spring, and for this reason a more-expensive thicker material is generally used, rather than a less-expensive thinner material but. However, the torsion coil spring formed by two coils is used so that even the less-expensive thinner material can have durability for millions of pushing operations.

The torsion coil spring can be pivotally supported on the plunger to rotate about the first shaft when the plunger slides downward.

The movable contact piece and the fixed contact piece form a contact unit (e.g., the contact unit 31 of FIG. 5).

EXPLANATION OF REFERENCE NUMERALS

1 Sound-function-equipped push-button switch
11 Button
12 First plunger
13 Second plunger
14 Torsion coil spring
15 Sounder
16 Movable contact piece
17 Fixed contact piece
18 Cover
19 Light emission member
20 Spacer
21 Connector
22 Coil spring
23 Housing
31 Contact unit
131 First shaft support portion
141 First shaft
142 Second shaft
143 Coil
151 Second shaft support portion
152 Lower end portion (of sounder)
153 Upper end portion (of sounder)
161 Movable portion
181 Hitting piece
191 Conductive portion
231 Corner portion (of inner wall of housing)
Pm Contact (of movable portion)
Pf Contact (of fixed portion)

The invention claimed is:

1. A sound-function-equipped push-button switch, comprising;

a button that accepts a pushing operation;

a plunger that slides in conjunction with the pushing operation of the button;

a torsion coil spring that stores or releases elastic energy during sliding of the plunger;

a sounder that slides using the elastic energy released at the same time as elastic deformation of the torsion coil spring and hits a hitting piece to generate a hitting sound;

a movable contact piece that has a movable-side contact that is moved by being pushed by the sliding sounder; and a fixed contact piece that has a fixed side contact that locks the movable-side contact at the fixed side contact at the same time or substantially at the same time as hitting of the sounder with the hitting piece.

2. The sound-function-equipped push-button switch according to claim 1, wherein the torsion coil spring has a first shaft pivotally-supported on the plunger and a second shaft pivotally-supported on the sounder, and stores elastic energy while bending such that the first shaft approaches the second shaft when the plunger slides downward in a state in which the second shaft is locked by the sounder, and when the plunger further slides in a state in which the first shaft is positioned closest to the second shaft, is reversed to release the stored elastic energy while stretching such that the second shaft moves apart from the first shaft and slides the sounder upward.

3. The sound-function-equipped push-button switch according to claim 2, wherein the torsion coil spring has two coils formed between the first shaft and the second shaft facing each other.

4. The sound-function-equipped push-button switch according to claim 2, wherein the torsion coil spring is pivotally supported on the plunger to rotate about the first shaft when the plunger slides downward.

5. The sound-function-equipped push-button switch according to claim 1, wherein the movable contact piece and the fixed contact piece form a contact unit.

* * * * *